US005142753A

United States Patent [19]

Bolliand et al.

[11] Patent Number: 5,142,753

[45] Date of Patent: Sep. 1, 1992

[54] PROCESS FOR TREATING TEXTILE PIECES BY HIGH PRESSURE WATER JETS

[75] Inventors: Robert Bolliand, Ecully; André Vuillaume, Biviers, both of France

[73] Assignee: Centre Technique Industriel dit: Institut Textile de France, France

[21] Appl. No.: 661,475

[22] Filed: Feb. 26, 1991

[30] Foreign Application Priority Data

Mar. 12, 1989 [FR] France ..... 90 03569

[51] Int. Cl.[5] ..... B28B 21/52

[52] U.S. Cl. ..... 28/167; 264/177.17

[58] Field of Search ..... 28/104, 168, 219, 217, 28/271, 283, 167; 264/176.1, 177.17, 210.1, 210.2

[56] References Cited

U.S. PATENT DOCUMENTS

| | | | |
|---|---|---|---|
| 3,403,862 | 10/1968 | Dworjanyn | 28/104 |
| 3,434,188 | 3/1969 | Summers | 28/104 |
| 3,750,236 | 8/1973 | Kalwaites | 28/104 |
| 4,085,485 | 4/1978 | Brandon et al. | 28/104 |
| 4,096,226 | 6/1978 | Martin et al. | 28/220 |
| 4,379,799 | 4/1983 | Holmes et al. | 28/104 |
| 4,485,535 | 12/1984 | Oishi | 28/168 |
| 4,647,490 | 3/1987 | Bailey et al. | 28/104 |
| 4,931,355 | 6/1990 | Radwanski et al. | 28/104 |
| 4,967,456 | 11/1990 | Sternlieb et al. | 28/104 |

*Primary Examiner*—Werner H. Schroeder
*Assistant Examiner*—Amy Brooke Vanatta
*Attorney, Agent, or Firm*—Ladas & Parry

[57] ABSTRACT

The process of treatment according to this invention is applied to a textile piece—weave, knit or finished article—constituted wholly or partly by yarns of continuous filaments with adherent microfilaments, obtained by star—or lamellar spinning, for example comprising six to eight unitary microfilaments of 0.2 to 0.4 dtex. It consists in subjecting said piece, resting on a support screen, to the action of jets of water at a pressure of at least $4 \cdot 10^6$Pa, whereby the structure of the piece is modified and the unitary microfilaments are separated.

6 Claims, 3 Drawing Sheets

PROCESS FOR TREATING TEXTILE PIECES BY HIGH PRESSURE WATER JETS

FIELD OF THE INVENTION

The present invention relates to a process for the treatment of textile pieces or articles made from woven or knitted fabrics, the treatment being of the mechanical finishing type and intended to modify the structure thereof, for example by increasing the bulk, improving the suppleness, modifying their surface appearance.

BACKGROUND OF THE INVENTION

Numerous mechanical finishing means exist, in which various members are employed, said members and their mode of action being selected as a function of the desired purpose: teazles, napping rollers to give a plush appearance to a piece made of spun yarns of fibers, fulling machine to give volume to the wool, vibrating belt or other device for mechanically projecting the piece on an obstacle in order to improve dimensional stability, etc . . . In all these techniques, the mechanical members come into contact with the textile piece and, during such contact, modify the structure that said piece had either after weaving or knitting or possibly after the finished article has been made, most often by a relative displacement of the yarns constituting the piece, or of the discontinuous fibers or continuous filaments constituting said yarns. In the majority of cases, such contact of the mechanical members is accompanied by a certain degradation of the piece by the filaments or fibers breaking. Furthermore, such contact between the pieces and the mechanical member may cause wear of the member and therefore a progressive change in the result obtained.

Yarn producers have proposed yarns constituted by continuous filaments with adherent microfilaments, obtained by star- or lamellar spinning. The pieces obtained by weaving or knitting such yarns are then subjected to a treatment intended to individualize the microfilaments, so that said piece has the suppleness, the touch, the bulk corresponding to the unitary microfilaments.

Such individualization of the microfilaments is effected with the aid of suitable chemical treatments in which the matrix ensuring adhesion of the unitary microfilaments, or superficially the interlamellar surface is attacked. In particular, sodium hydroxide is used for such chemical treatments when the microfilaments are made of polyester.

Such chemical treatments present multiple drawbacks: it is difficult perfectly to monitor all the parameters to obtain a uniform treatment (duration of treatment, temperature, concentration of the bath); the piece thus treated loses weight due to its partial dissolution; the treatments are long and expensive.

In the following text, the general term "piece" will designate all presentations of the woven or knitted fabrics: fabric or knit leaving the loom and in the form of a web of large length, part cut out from such a web or finished article.

It is an object of the present invention to propose a simplified treatment of textile pieces which not only modifies the structure thereof without causing continuous filaments in the yarns constituting the piece or article treated to break, but also, the constituent yarns being continuous filaments with adherent microfilaments, effects individualization of said microfilaments.

SUMMARY OF THE INVENTION

This perfectly attained by the process of the invention, which consists in treating a textile piece, resting on a support screen, said piece being constituted wholly or partly by yarns of continuous filaments with adherent microfilaments, by action of water jets at a pressure of at least $4 \cdot 10^6$ Pa, whereby the action of the water jets separates the microfilaments.

It is true that documents EP.A.10 546 and EP.A.193 0378 disclose treatments of textile pieces, in which said pieces are subjected to the action of jets of fluid at high pressure.

In EP.A.193 078, the purpose of the action of the water jets is to render more open the fibrous structure of a weave of inorganic fibers to reinforce resin, particularly for printed circuit boards.

In EP.A.10 546, the purpose of the action of the water jets is to give the fabric the velvet appearance of a natural suede. The possibility is provided to use composite yarns with adherent microfilaments, but, in that case, the fabric undergoes various treatments prior to the action of the fluid jets, which are intended to individualize the microfilaments, relaxation in a bath of hot water, drying, napping, heat-fixing.

Applicants therefore have the merit of having proved that the action of water jets at a pressure of at least $4 \cdot 10^6$Pa was capable of separating the unitary microfilaments, in addition to the modification of the structure proper, without break of the microfilaments: the unitary microfilaments of the filaments are detached, either from one another if it is a question of lamellar spinning, or from the matrix if it is a question of star spinning.

The process of the invention makes it possible to obtain a perfectly reproducible effect, being a question of simple adjustments of the physical conditions: speed of the screen, pressure of the water jets, in particular.

The support screen preferably moves continuously beneath a plurality of pipes each comprising an assembly of nozzles for spraying water jets at high pressure, the pressure of the water being identical or different from one spray nozzle pipe to another. The piece is advantageously subjected to the action of jets at increasingly higher pressures.

For example, the speed of advance of the piece being included between 20 and 100 m/mins, the latter is successively subjected to the action of four spray nozzle pipes with pressures stepped respectively from $4 \cdot 10^6$ to $20 \cdot 10^6$Pa.

Certain yarns constituting the piece are for example yarns composed of filaments with adherent microfilaments obtained by star spinning, each filament having a count of about 2dtex and comprising from 6 to 8 unitary microfilaments of polyester of 0.2 to 0.4 dtex, assembled thanks to a polyamide matrix.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
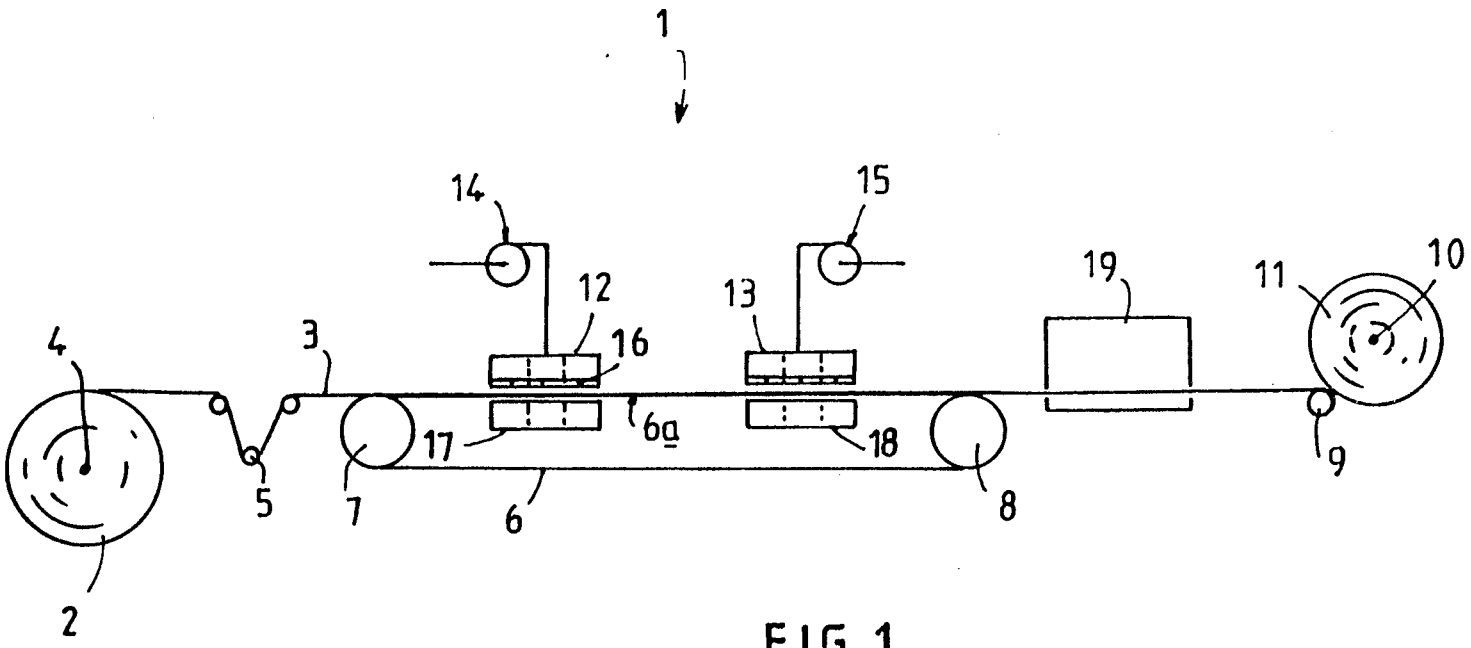
FIG. 1 is a schematic side view of the treatment installation.

Referring now to the drawings, the treatment installation 1 which will be described is particularly suitable for textile pieces, weaves or knits, wound in the form of rolls 2 of continuous webs. This installation 1 comprises an assembly of means for positioning and conveying the piece 3, namely, from upstream to downstream: a shaft 4, driven by a motor (not shown), on which is fitted roll 2, tensioning rollers 5, a support screen 6 consisting of an endless belt wound around and stretched between two cylinders 7, 8 driven at the same linear speed as the shaft 4, the piece 3 resting on the upper part 6*a* of the belt 6, and, finally, a guide roller 9 cooperating with a shaft 10 for winding the roll 11 constituted by the treated piece 3.

To simplify the drawings, FIG. 1 shows only two spray nozzle pipes 12, 13 for spraying water at high pressure. Each pipe is supplied by a pump 14, 15 capable of working at adjustable pressures, ranging from $4 \cdot 10^6$Pa (40 bars) to more than $20 \cdot 10^6$Pa (200 bars). Each pipe 12, 13 comprises a plate pierced with an assembly of orifices acting as spray nozzles 16 distributed, on the one hand, over the whole useful width of the belt 6 at a rate of one orifice every 2 mm, and, on the other hand, over several rows, for example three rows have been shown in FIG. 1. The water at high pressure emerging from spray nozzles 16 is in the form of extremely fine jets, having a diameter of the order of 100 to 150 micrometers.

Suction boxes 17, 18 are placed opposite the spray nozzle pipes 12, 13 beneath the upper part 6*a* of the belt 6, whilst the pipes are located above this upper part 6*a*, the nozzles 16 being directed perpendicularly to the plane of said upper part 6*a* and therefore to piece 3.

The support belt 6 is a metal screen of 100 mesh (i.e. 100 meshes to the inch) made with wires having a diameter of 200 micrometers.

A drying tunnel 19 is placed on the passage of the treated piece 3 after cylinder 8 and before guide roller 9.

Figure 2A:
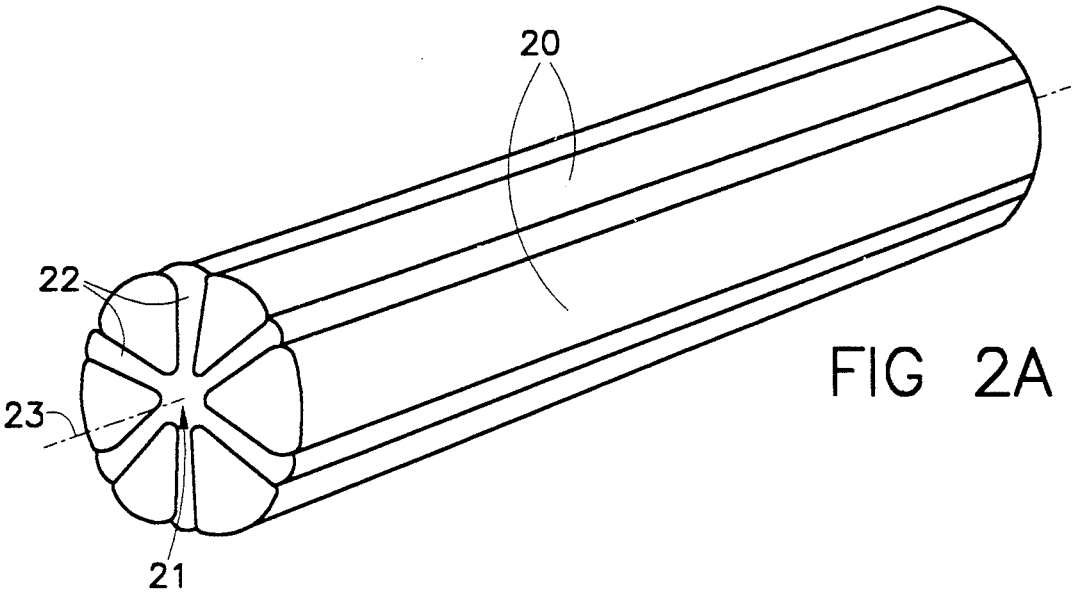
FIGS. 2A and 2B are schematic views in perspective of a filament with adherent microfilaments in star-form before treatment (FIG. 2A) and after treatment (FIG. 2B).

A polyester fabric of about 130 g/m$^2$ has been treated, having as warp yarn a conventional yarn of 90 dtex, and comprising 136 continuous filaments, and, as weft yarn, a yarn of continuous filaments with adherent microfilaments obtained by star spinning. Such a yarn is shown in FIG. 2A. It comprises six unitary microfilaments 20 of polyester; each microfilament 20 has, in cross section, the form of a segment of orange; the six microfilaments 20 are separated by a matrix 21 of polyamide having six radial arms 22 symmetrically distributed about the longitudinal axis 23. Each unitary microfilament 20 of polyester has a count of between 0.2 and 0.4 dtex.

Treatment of the above fabric was effected at 20 m/mins, by passage beneath four spray nozzle pipes, the water being at respective pressures of $6 \cdot 10^6$Pa, $8 \cdot 10^6$Pa and $20 \cdot 10^6$Pa.

Figure 2B:
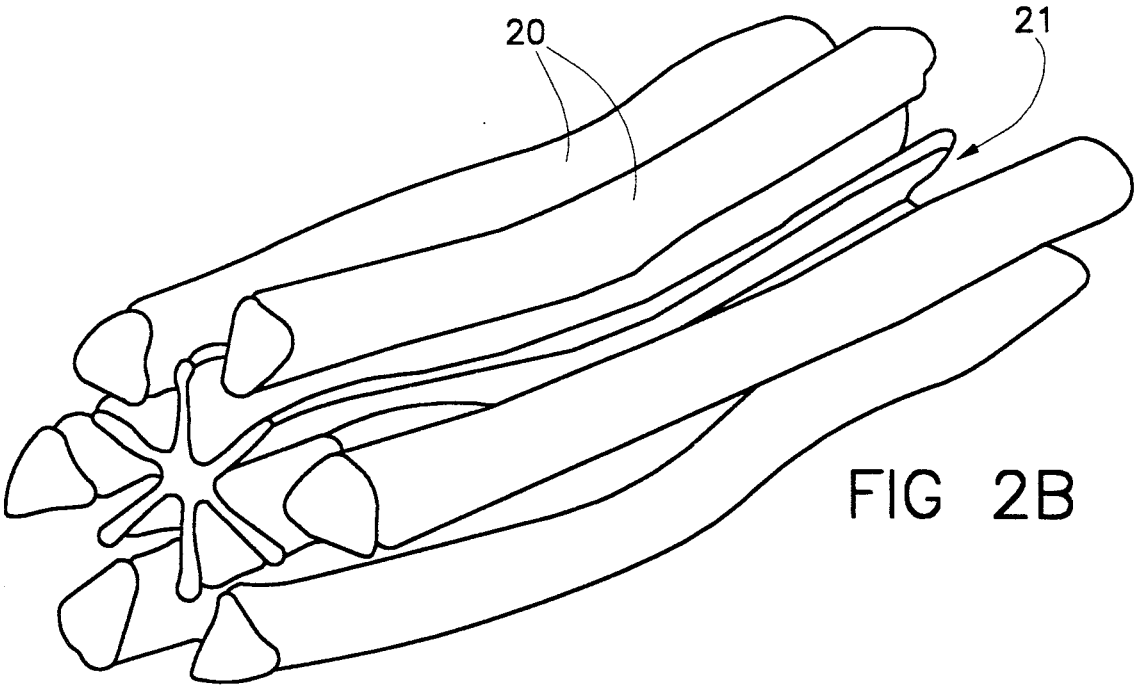

After such a treatment, it is observed that the unitary microfilaments 20 have separated from the matrix 21, under the impact of the jets of water, as illustrated in FIG. 2B. However, no degradation is observed either of the microfilaments 20 or of the matrix 21; the fabric has therefore lost no weight.

The combined action of the individualization of the unitary microfilaments 20 and of the relative displacement of said microfilaments 20 with respect to one another due also to the action of the water jets, gives the fabric a considerable suppleness and a very high distribution of the filaments and of the microfilaments with respect to the volume of the fabric.

Figure 3:
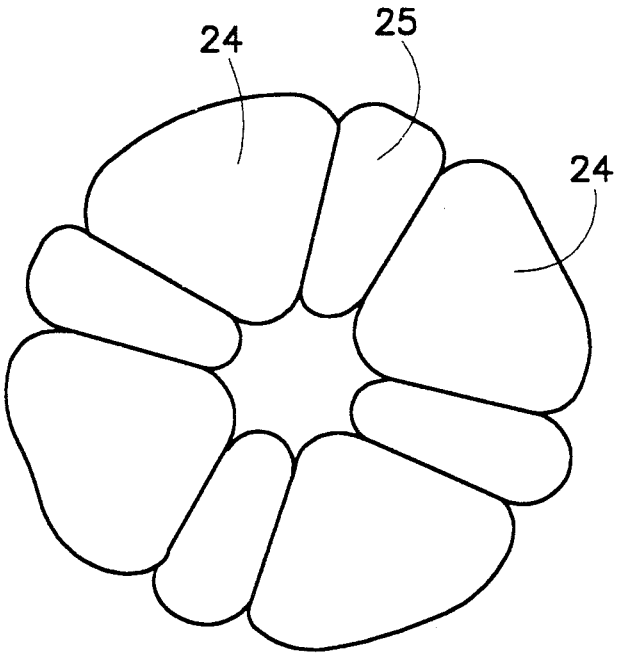
FIG. 3 is a schematic view in transverse section of a filament with adherent microfilaments without matrix.
Figure 4:
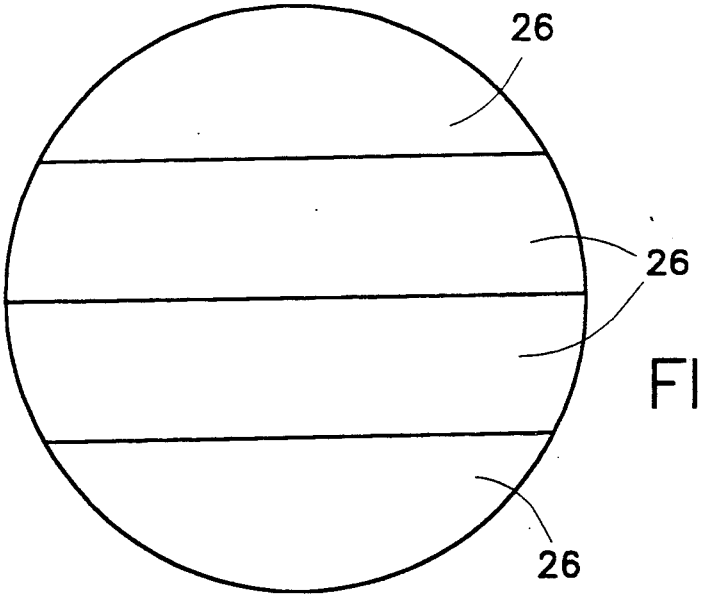
FIG. 4 is a schematic view in transverse section of a filament with lamellar adherent microfilaments.

Other types of yarns with adherent microfilaments exist, particularly those shown in FIGS. 3 and 4. FIG. 3 shows a yarn without core, i.e. the matrix for adhesion of the four microfilaments 24 of polyester is constituted by four microfilaments 25 of polyamide adhering to two successive microfilaments 24 of polyester.

FIG. 4 shows a yarn of the lamellar type in which the microfilaments 26 of polyester correspond to longitudinal slices of a filament of substantially circular section. Auto-adhesion between the four microfilaments 26 is obtained due to the fact that, at spinning, the four lamellae are connected only after a certain cooling time of the polyester.

The textile pieces made with yarns with adherent microfilaments as described hereinabove were treated on installation 1. It has also been ascertained that the microfilaments 24, 26 were individualized under the impact of the high pressure water jets, without degradation.

The invention is not limited to the treatments which have been described by way of non-limiting examples, but covers all the variants thereof.

It will be understood that the invention is based on the use of jets of water at pressures of at least $4 \cdot 10^6$Pa (40 bars) in order to modify the structure of textile pieces, weaves or knits, of which the constituent yarns are already assembled together. Such structural modification consists in the mechanical separation and the relative displacement of microfilaments which, in the yarn before treatment and during weaving or knitting, had a certain adherence.

Starting from this concept, the man skilled in the art will select the conditions of treatment as a function of the piece to be treated and of the desired effect. In particular, a localized treatment or a treatment at locally different pressures may lead to special effects, without departing from the scope of the present invention.

What is claimed is:

1. A process for individualizing unitary microfilaments in a textile piece constituted wholly or partly by yarns of continuous filament with adherent microfilaments, said process comprising the step of subjecting said piece, resting on a support screen, to the action of jets of water at a pressure of at least $4 \cdot 10^6$Pa.

2. The process of claim 1, wherein, the support screen moving continuously, the piece passes beneath a plurality of pipes spraying water at adjustable pressure.

3. The process of claim 2, wherein the textile piece moves at a speed between 20 and 100 m/min and the piece passes beneath at least four pipes spraying water respectively at pressures stepping up from $4 \cdot 10^6$Pa to $20 \cdot 10^6$Pa.

4. The process of one of claims 1 to 3, wherein the water jets have a diameter of between 100 and 150 micrometers.

5. The process of claim 1, wherein the continuous filaments with adherent microfilaments comprise six to eight unitary microfilaments of 0.2 to 0.4 dtex.

6. The process of claim 5, wherein the yarns of continuous filaments with adherent microfilaments are obtained by star spinning an include a matrix, and the unitary microfilaments are of polyester and the matrix of polyamide.

* * * * *